US007414014B2

(12) United States Patent
Natoli et al.

(10) Patent No.: US 7,414,014 B2
(45) **Date of Patent: *Aug. 19, 2008**

(54) METHOD AND SYSTEM FOR IMPROVING FUEL ECONOMY AND ENVIRONMENTAL IMPACT OPERATING A 2-STROKE ENGINE

(75) Inventors: Giuseppe Natoli, Turin (IT); Giulio Giovanni Pometto, Turin (IT); Alfio Bonciolini, Turin (IT); Hans Heinrich Petersen, Solrød Strand (DK); Jørn Dragsted, Allerød (DK); Claus Martin Olesen, Hillerod (DK); Klaus-Werner Damm, Chagrin Falls, OH (US)

(73) Assignee: A.P. Moeller-Maersk/AS, Copenhagen K. (DK)

( * ) Notice: Subject to any disclaimer, the term of this patent is extended or adjusted under 35 U.S.C. 154(b) by 285 days.

This patent is subject to a terminal disclaimer.

(21) Appl. No.: 11/027,573

(22) Filed: Dec. 30, 2004

(65) Prior Publication Data

US 2006/0148661 A1 Jul. 6, 2006

(51) Int. Cl.
*C10M 129/72* (2006.01)
*C10M 133/56* (2006.01)

(52) U.S. Cl. ..... 508/459; 508/189; 508/528

(58) Field of Classification Search ..... 508/189, 508/459, 528

See application file for complete search history.

(56) References Cited

U.S. PATENT DOCUMENTS

| | | | | |
|---|---|---|---|---|
| 5,067,455 | A | 11/1991 | Okajima et al. | |
| 5,282,990 | A | 2/1994 | Yoneto et al. | |
| 5,741,764 | A * | 4/1998 | Patel et al. | 508/459 |
| 6,040,279 | A | 3/2000 | Addagarla et al. | |
| 6,074,995 | A | 6/2000 | Dohner | |
| 2003/0171223 | A1 | 9/2003 | Winemiller et al. | |
| 2003/0183188 | A1 * | 10/2003 | Carey et al. | 123/195 P |
| 2004/0144355 | A1 * | 7/2004 | Carey et al. | 123/196 R |

FOREIGN PATENT DOCUMENTS

| | | | |
|---|---|---|---|
| EP | 0573231 | | 12/1993 |
| EP | 1 229 101 | | 8/2002 |
| JP | 07054627 | A * | 2/1995 |

* cited by examiner

*Primary Examiner*—Glenn Caldarola
*Assistant Examiner*—Jim Goloboy
(74) *Attorney, Agent, or Firm*—Morgan, Lewis & Bockius LLP

(57) ABSTRACT

A method and system to reduce fuel consumption and environmental impact in a two-stroke engine. Fresh system oil having a TBN less than 10 is provided and used in the two-stroke engine to produce partially used system oil. The partially used system oil is withdrawn from the two stroke engine and at least one friction modifier is added to at least some of the withdrawn partially used system oil, wherein the addition of the at least one friction modifier reduces the friction coefficient of the withdrawn system oil, resulting in a system oil having reduced friction. The system oil with reduced friction is combined with partially used system oil remaining in said two-stroke and the combined system oil is used to lubricate pistons of said two-stroke engine.

20 Claims, 2 Drawing Sheets

METHOD AND SYSTEM FOR IMPROVING FUEL ECONOMY AND ENVIRONMENTAL IMPACT OPERATING A 2-STROKE ENGINE

FIELD OF THE INVENTION

The invention relates to a method of reducing fuel consumption, lubricant complexity and environmental impact in the operation of a two-stroke engine. Further, the invention relates to a system for reducing fuel consumption, extended lubricant utilization and environmental impact in a two-stroke engine.

BACKGROUND OF THE INVENTION

Two-stroke cross-head engines used in marine and/or stationary applications are equipped with two separate lubricating oil systems. One lubricating system comprises so-called system oil that normally is used for lubrication and cooling of the engine's bearings and e.g. oil-cooled pistons as well as for activation and/or control of various valves or the like. The other lubricating system comprises an all-loss lubricant (cylinder oil) that normally is used for lubrication of the engine's cylinders, piston rings and piston skirt.

In typical two-stroke cross-head engines, the cylinder oil is spent continuously by each turn of the engine whereas the system oil in principle is not spent (except by smaller unintentional leakages). The lubrication system comprising the cylinder oil is also often referred to as an "all-loss" lubrication system as the oil is spent. The use of and various types of both system oil(s) and cylinder oil(s) is very well known in the art.

The cylinder oil typically contains certain additives that function to reduce, minimize or neutralise the acid level of the cylinder system.

Typical cylinder oils usually have an SAE (Society of Automotive Engineering) viscosity equivalent to about 50 and normally have a total base number (BN) of about 40 to 70 for the neutralisation of acid products produced during the combustion process. Typical system oils usually have an SAE viscosity of about 30 with a relatively low BN content, typically around 5 and provide long-time performance. These exemplary values may vary dependent on the actual application and the specific design of the systems that the oils are used in.

In recent two-stroke cross-head engine designs involving electronic and/or hydraulic control and/or activation of valves, etc., the minimum performance requirements of the system oil has been substantially increased compared to earlier design using traditional mechanical control/activation.

The performance level of lubricants is typically measured periodically and may not go beyond certain limits if the oiled component's condition should not be jeopardized. One cause of performance loss is caused by particle contamination. These particles include combustion by-products and wear components, which can be partially removed by oil separators. However, in the case of two-stroke cross-head engines, one of the sources of contamination is spent cylinder oil leakage past the stuffing box causing both the viscosity and base number of the system oil to increase over time, a process that cannot be reversed by separators. This causes the system oil to gradually degrade over time so component wear increases and engine efficiency decreases. When the system oil is approaching its condemning limit it will have to be replenished or changed.

Patent specification U.S. Pat. No. 6,074,995 discloses a friction modifier composition comprising an oil of lubricating viscosity and containing a friction-reducing amount of an additive.

Patent specification U.S. Pat. No. 5,282,990 discloses adding a synergistic blend of friction modifiers to a crankcase lubricating oil of an internal combustion engine in order to improve the fuel economy. However, there is no suggestion of how to apply this with respect to a two-stroke diesel engines.

Patent specification EP 0 573 231 discloses triglycerides as friction modifiers added to oil for improved fuel economy in an internal combustion engine.

Patent application US 2003/0171223 discloses lubricating oil compositions with improved friction properties.

OBJECT AND SUMMARY OF THE INVENTION

It is an object of the present invention to provide a method and a corresponding system of reducing fuel consumption and environmental impact operating a two-stroke engine that solves the above-mentioned (and other) shortcomings of prior art. A further object is to provide this in an easy and efficient way.

A further object of the present invention is to enable improvement of fuel economy or fuel efficiency in a two-stroke diesel engine.

Another object is to reduce emissions from a two-stroke diesel engine.

Another object is to enable use of a less-complex consumable system oil yet providing the same performance levels as experienced with conventionally-formulated system oils.

Yet another object is to enable extended component life of a two-stroke diesel engine.

An additional object is to provide a more environmentally friendly operation of the engine.

These objects, among others, are achieved by a method (and a corresponding system) of reducing fuel consumption in a two-stroke engine comprising the steps of: obtaining system oil/consumable system oil from an engine, adding at least one friction modifier to at least a part of the obtained system oil, where the addition of the at least one friction modifier reduces the friction coefficient of the obtained oil, resulting in a system oil/consumable system oil with reduced friction, and supplying said oil with reduced friction to said engine.

In this way, the fuel consumption of the engine is reduced, i.e. improved fuel economy is obtained, due to the presence of the added friction modifier(s) giving the system oil/consumable system oil fed back into the engine reduced friction characteristics.

Additionally, extended component operational time is obtained since less friction is present between the components of the engine(s) due to the addition of the friction modifier(s). This results in less frequent maintenance and savings of costs.

Further, reduced emissions from the engine(s) are obtained since less fuel is used due to the less friction between engine components obtained by the addition of the friction modifier (s) according to the present invention.

In one embodiment, at least one of the friction modifier(s) is/are an ash-less friction modifier.

In one embodiment, the at least one ash-less friction modifier is based on di-, tri- and/or tetra-esters of dimeric and/or fatty acids and/or fatty amides.

In another embodiment, the at least one ash-less friction modifier is based on neopentylglycol, pentaerythritol, sorbitol, trimethylpropanol, glycerol and/or triethanolamine or blends thereof.

In a preferred embodiment, the at least one friction modifier is based on one or more selected from the group of:

- triglycerides (of animal and/or vegetable origin), such as rape seed, soy bean, and/or castor oil,
- fatty phosphates,
- fatty acid amides,
- fatty epoxides,
- borated fatty epoxides,
- fatty amines, e.g. triethanolamine
- polyol esters, e.g. of glycerol, pentaerythritol, neopentylglycol, sorbitol, trimethylpropanol,
- borated polyol esters alkoxylated fatty amines,
- borated alkoxylated fatty amines,
- metal salts of fatty acids,
- sulfurized olefins,
- fatty imidazolines, or
- mixtures thereof In one embodiment, the least one friction modifier is added at a predetermined rate so that the concentration of the added friction modifier(s) has a concentration of 0.2-2.0% of said system oil/consumable system oil with reduced friction.

In an alternative embodiment, the at least one friction modifier is added at a predetermined rate so that the concentration of the added friction modifier(s) has a concentration of 0.5-1.5% of said system oil/consumable system oil with reduced friction.

In an alternative embodiment, the method involves use of a consumable system oil, containing a simplified additive composition and/or a reduced additive treat rate.

In one embodiment, the method is used offshore, on-site, on-board a vessel, and/or in a land based plant.

In a preferred embodiment, the method further comprises the step of: tapping a predetermined first amount of the system oil/consumable system oil providing tapped oil and replenishing the remaining system oil/consumable system oil with a predetermined second amount of fresh(er) system oil/consumable system oil, with tapping and/or replenishing done continuously, near-continuously or intermittently.

In another preferred embodiment, the method further comprises the steps of: creating a cylinder oil on the basis of the tapped system oil/consumable system oil by determining at least one critical parameter (e.g. BN, viscosity, permittivity/capacitance and/or elemental composition) of the tapped oil, determining at least one desired parameter (e.g. BN, viscosity, permittivity/capacitance and/or elemental composition) of the cylinder oil and adjusting said at least one critical parameter (e.g. BN, viscosity, permittivity/capacitance and/or elemental composition) of the tapped system oil/consumable system oil accordingly by blending the tapped oil with at least one BN modifying additive resulting in a created cylinder oil, and supplying said created cylinder oil to cylinders or part of the cylinders of said engine.

In one embodiment, the system oil is selected from the group of:

- a traditional system oil comprising additives for longtime performance or formulated with an additive treat-rate providing long-time performance, and
- a consumable system oil without long-time performance additives or formulated with a reduced additive treat-rate not providing long-time performance.

The present invention also relates to a system for reducing fuel consumption in a two-stroke engine, which corresponds to the method of the present invention and have the same advantages for the same reasons.

More specifically, the invention relates to a system for reducing fuel consumption in a two-stroke engine comprising a blending unit for adding at least one friction modifier to at least a part of an obtained system oil/consumable system oil, where the addition of the at least one friction modifier reduces the friction coefficient of the obtained system oil/consumable system oil, resulting in a system oil/consumable system oil with reduced friction and for supplying said system oil/consumable system oil with reduced friction to said at least one engine.

Advantageous embodiments of the system according to the present invention are defined in the sub-claims and described in detail in the following. The embodiments of the system correspond to the embodiments of the method and have the same advantages for the same reasons.

BRIEF DESCRIPTION OF THE DRAWINGS

These and other aspects of the invention will be apparent from and elucidated with reference to the illustrative embodiments shown in the drawing, in which.

DESCRIPTION OF PREFERRED EMBODIMENTS

Figure 1:
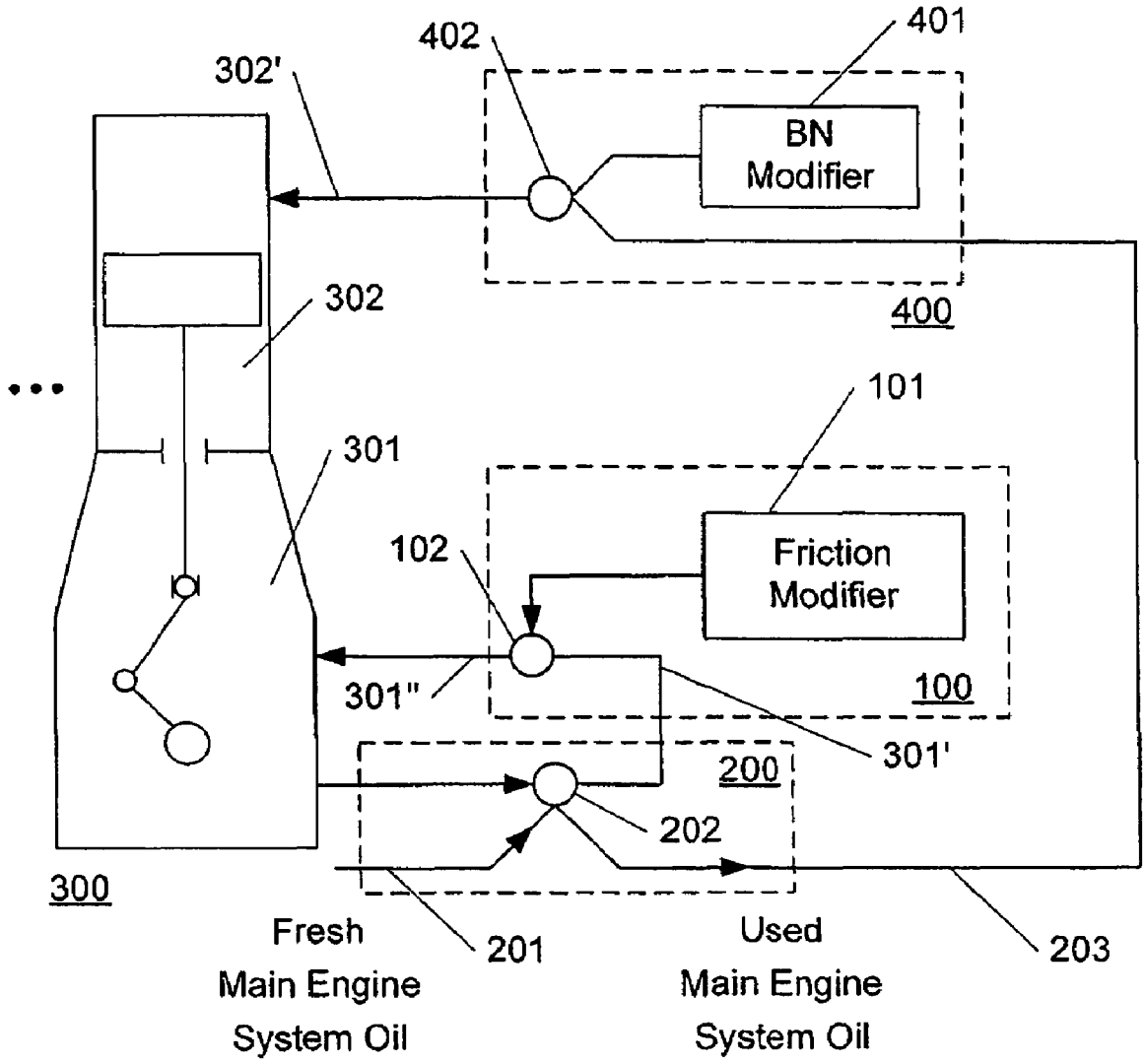
FIG. 1 shows a schematic block diagram of one embodiment of the present invention.

FIG. 1 shows a schematic block diagram of one embodiment of the present invention. Shown is a schematic representation of at least one two-stroke cross-head diesel engine (300). The engine comprises one lubricating system comprising so-called system oil (301) that normally is used for lubrication and cooling of the engine's bearings and e.g. oil-cooled pistons as well as for activation and/or control of various valves or the like. Another lubricating system comprises an all-loss lubricant or cylinder oil (302) that normally is used for lubrication of the engine's cylinders, piston rings and piston skirt.

The engine (300) corresponds to well-known prior art two-stroke engines except as explained in the following.

Also illustrated is, according to the present invention, a friction modifying method/system (100) reducing fuel consumption in a two-stroke engine. The friction modifying method/system (100) obtains system oil (301') from at least one engine (300) where a controller or blending unit (102) adds at least one friction modifier (101) to (at least a part of) the obtained oil (301'). The addition of the at least one friction modifier (101) reduces the friction coefficient of the obtained system oil/consumable system oil (301'), resulting in a system oil with reduced friction (301"), which is supplied back to the engine(s) (300) as system oil.

This results in avoiding or minimising frictional losses caused by contamination of the system oil/consumable system oil, which normally takes place as the oil is used and which would otherwise cause substantial diminished efficiency, increased fuel consumption and increased emissions. Great economical savings are achieved by avoiding this.

The system oil is preferably selected from the group of:

- a traditional system oil comprising additives for long-time performance or formulated with an additive treat-rate providing long-time performance, and a consumable system oil without long-time performance additives or formulated with a reduced additive treat-rate not providing long-time performance.

Preferably, the friction modifier(s) (101) is/are ash-less friction modifier(s), which may be based on di-, tri- and/or tetra-esters of dimeric and/or fatty acids and/or fatty amides.

The ash-less friction modifier(s) may also be based on neopentylglycol, pentaerythritol, sorbitol, trimethylpropanol, glycerol and/or triethanolamine or blends of two or more of the above.

In a preferred embodiment, the least one friction modifier may be based on one or more of: triglycerides, such as castor oil, fatty phosphates, fatty acid amides, fatty epoxides, borated fatty epoxides, fatty amines, e.g. triethanolamine, polyol esters, e.g. of glycerol, pentaerythritol, neopentylglycol, sorbitol, trimethylpropanol, borated polyol esters alkoxylated fatty amines, borated alkoxylated fatty amines, metal salts of fatty acids, sulfurized olefins, fatty imidazolines, or mixtures thereof The friction modifier(s) may also be other compounds, e.g. as disclosed in the cited prior art documents and elsewhere. See e.g. patent specification U.S. Pat. No. 4,792,410 and U.S. Pat. No. 5,110,488.

According to one embodiment, the friction modifier(s) (101) is/are added at a predetermined rate so that the concentration of the added friction modifier(s) (101) has a concentration of 0.2-2.0% of the system oil/consumable system oil with reduced friction (301"). In an alternative embodiment, the friction modifier(s) (101) is/are added at a predetermined rate so that the concentration of the added friction modifier(s) (101) has a concentration of 0.5-1.5% of the system oil/consumable system oil with reduced friction (301"). According to another embodiment, the controller or blending unit (102) varies the rate of added friction modifier (101) according to a predetermined scheme, i.e. so not necessarily the same rate is used all the time.

According to one embodiment, the system oil/consumable system oil is a consumable system oil having a reduced and/or modified additive composition reflecting its reduced oil life.

The present invention may e.g. be used offshore, on-site, on-board a vessel, and/or in a land based plant or the like.

According to a preferred embodiment of the present invention, the system/method further comprises a tapping and replenishing system/method (200) where a controller (202) controls tapping a predetermined amount of the obtained system oil/consumable system oil (301') providing tapped oil (203) and replenishing the remaining system oil/consumable system oil (301') with a predetermined second amount of fresh(er) system oil/consumable system oil (201). In this way, a part of the system oil/consumable system oil to be added with a friction modifier is replenished. Alternatively, the tapping and/or replenishing may be done continuously, near-continuously, intermittently or according to other suitable schemes.

As used system oil/consumable system oil is tapped and replenished with fresh, unspent or less spent system oil, the resulting system oil/consumable system oil is of a more consistent quality and gradual deterioration is minimised or avoided. In this way, enhanced and consistent performance of the initial fluids resulting in further reduced component wear and equipment lifecycle cost is provided.

In effect, this provides a 'consumable' system oil/consumable system oil as a part of the spent system oil/consumable system oil is tapped and replenished with fresh or fresher system oil. This is novel compared to prior art system oil/consumable system oil where the system oil/consumable system oil is kept in the engine system until about it has been degraded too much for efficient use. After this It has to be replaced and the spent system oil/consumable system oil would have to be handled as waste. A further advantage of this is that the requirements for the system oil/consumable system oil in this system are different than prior art requirements. Standard system oil/consumable system oil for prior art systems usually contains an additive package to secure a long lifetime of the system oil. System oil/consumable system oil with a prior art additive package is significantly more expensive than a similar system oil/consumable system oil without the prior art additive package or with a new additive package designed for a "consumable" system oil. The present system can function with system oil/consumable system oil using a reduced and/or modified additive package ensuring sufficient oil life since it is tapped and replenished. This leads to reduced expenses since cheaper oil can be used in the system. Preferably, the tapped oil is used instead of becoming waste as described in the following.

The tapping/replenishment system (200) may feed directly into the engine or be part of a separate loop, instead of the one used for addition of friction modifier(s) to the system oil/consumable system oil (301').

In another preferred embodiment, the system/method further comprises a BN modifying system/method (400) that converts used system oil/consumable system oil into useable cylinder oil. See e.g. patent specifications U.S. Provisional 60/612,899 and European patent application number 04388064.0, both of the same applicant and both incorporated herein by reference, for specific details of one implementation of a BN modifying system/method (400).

In this embodiment the BN (total base number) modifying system/method (400) comprises a controller (402) for creating a cylinder oil on the basis of the tapped system oil/consumable system oil (203) by determining the BN of the tapped oil (203), determining a desired BN of the cylinder oil (302) and adjusting the BN of the tapped oil (203) accordingly by blending the tapped oil (203) with at least one BN modifying additive (401) resulting in a cylinder oil (302'), where said cylinder oil (302') is supplied to cylinders or part of the cylinders of said engine (300).

In this way, a method and system for converting/re-cycling a (used/spent) system oil/consumable system oil into a useable cylinder oil by adjusting BN is provided. This results in significant economical benefits since system oil/consumable system oil that otherwise ultimately would have to be disposed-of can be re-used/re-cycled as a total-loss cylinder lubricant. In addition, a more cost-effective consumable system oil can be used. Furthermore, cylinder oil does not have to be purchased. The system oil/consumable system oil used to blend the cylinder oil is of more consistent quality as it is replenished (contrary to the traditional practice) which reduces machinery wear, etc. Thus, the replenishment of the initial fluid(s) provides enhanced and consistent performance of the initial fluids resulting in greatly reduced component wear and equipment lifecycle cost. Even further, a more environmentally friendly method/system is provided since waste, in the form of spent oil(s) that is discarded after prolonged use, is reduced as it is converted into cylinder oil.

The BN modifying additive may e.g. comprise at least one base. Preferably the at least one base comprises basic salts of alkaline or earth alkaline elements, and/or detergents and/or dispersants. The cylinder oil may be created with a BN in response to fuel oil characteristics and/or actual engine operating requirements. Further the BN of the cylinder oil may be chosen based upon sulphur-content of the used system oil. The used system oil/consumable system oil may e.g. be selected from a group of lubricants, hydraulic fluids, gear oils, system oils, trunk piston engine oils, turbine oils, heavy duty diesel oils, compressor oils, etc.

The alkaline/earth alkaline elements may e.g. be K, Na, Ca, Ba, Mg or the like. The basic salts may belong to the inorganic chemical families of e.g. oxides, hydroxides, carbonates, sulphates or the like. The detergents may belong to the organic chemical families of e.g. sulphonates, salicylates, phenates, sulfophenates, Mannich-bases and the like. The dispersants may belong to the organic chemical families of succinimides or the like.

Alternatively, the conversion of spent/used system oil/consumable system oil into cylinder oil may be done without replenishing, i.e. the BN modifying system (400) is connected directly into the engine or is connected to a tapping system without replenishment.

Figure 2A:
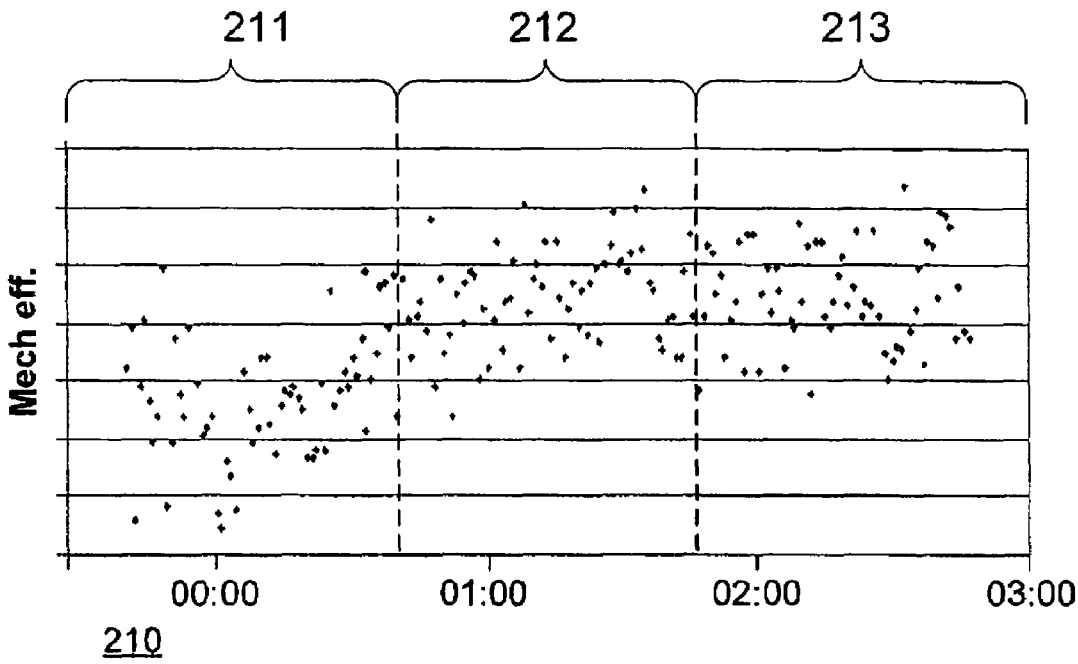
FIGS. 2*a* and 2*b* illustrate the effects of the present invention during a test.
Figure 2B:
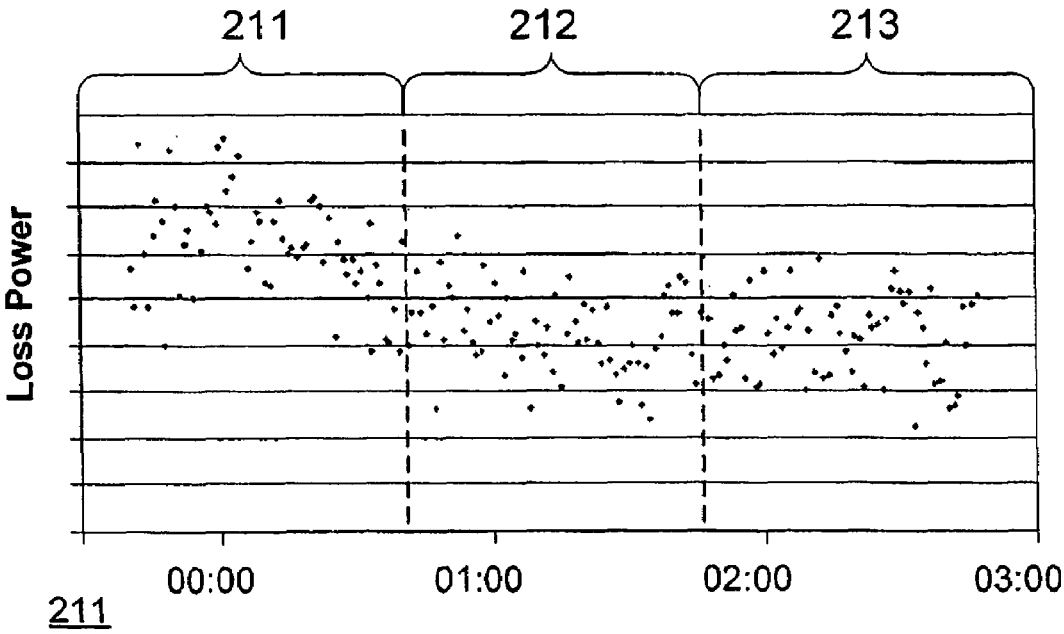

FIGS. 2*a* and 2*b* illustrate the effects of the present invention during a test. Shown in FIG. 2*a* is a graph (210) illustrating the mechanical efficiency of an engine before, during and after use of the present invention where system oil/consumable system oil from the engine is modified by adding at least one friction modifier to at least a part of the system oil. The graph is separated into a first part (211) illustrating measurements in a period before application of the present invention, i.e. traditional efficiency, a second part (212) illustrating measurements in a period during application of the present invention and a third part (213) illustrating measurements in a period after application of the present invention.

As can be seen by the graph (210) the overall mechanical efficiency, i.e. the rate between the effective power output from the engine seen in relation to an indicated maximum power output from the engine, is increased by modifying the system oil/consumable system oil by adding at least one friction modifier according to the present invention. More specifically, it can be seen that the mechanical efficiency generally is higher in the second and third part (212; 213) of the graph (210), i.e. during and after application of the present invention.

Shown in FIG. 2*b* is a graph (210) illustrating the loss of power of an engine before, during and after use of the present invention. The graph is separated into a first part (211) illustrating measurements in a period before application of the present invention, i.e. traditional efficiency, a second part (212) illustrating measurements in a period during application of the present invention and a third part (213) Illustrating measurements in a period after application of the present Invention. As can be seen by the graph (210) the overall loss of power is generally reduced in the second and third part (212; 213) of the graph (210), i.e. during and after application of the present invention.

In the claims, any reference signs placed between parentheses shall not be constructed as limiting the claim. The word "comprising" does not exclude the presence of elements or steps other than those listed in a claim. The word "a" or "an" preceding an element does not exclude the presence of a plurality of such elements.

The invention claimed is:

1. A method of reducing fuel consumption and environmental impact in a two-stroke engine comprising the steps of:

providing a fresh system oil having a TBN less than 10;

using said fresh system oil in the two-stroke engine to produce partially used system oil;

withdrawing at least some of the partially used system oil from the two stroke engine adding at least one friction modifier to at least a part of the withdrawn partially used system oil, where the addition of the at least one friction modifier reduces the friction coefficient of the withdrawn system oil, resulting in a system oil with reduced friction, and combining said system oil with reduced friction with partially used system oil remaining in said two-stroke engine; and using said combined system oil to lubricate pistons of said two-stroke engine.

2. A method according to claim 1, wherein at least one of said at least one friction modifier comprises an ash-less friction modifier.

3. A method according to claim 2, wherein said at least one ash-less friction modifier includes one or more of the following: di-, tri-and tetra-esters of dimeric acids and di-, tri- and tetra-esters of fatty acids and di-, tri- and tetra-esters of fatty amides.

4. A method according to claim 2, wherein said at least one ash-less friction modifier includes one or more of the following: neopentylglycol, pentaerythritol, sorbitol, trimethylpropanol, glycerol, triethanolamine and blends thereof.

5. A method according to claim 2, wherein said at least one friction modifier is based on one or more selected from the group consisting of: triglycerides of animal origin, triglycerides of vegetable origin, fatty phosphates, fatty acid amides, fatty epoxides, borated fatty epoxides, fatty amines, polyol esters, borated polyol esters alkoxylated fatty amines, borated alkoxylated fatty amines, metal salts of fatty acids, sulfurized olefins, fatty imidazolines, and mixtures thereof.

6. A method according to claim 1, wherein said at least one friction modifier is added at a predetermined rate so that the added friction modifier(s) has a concentration ranging from 0.2% to 2.0% of said system oil with reduced friction.

7. A method according to claim 1, wherein said at least one friction modifier is added at a predetermined rate so that the added friction modifier(s) has a concentration ranging from of 0.5% to 1.5% of said system oil with reduced friction.

8. A method according to claim 1, wherein the method is performed at one or more of the following: offshore, on-site, on-board a vessel, and in a land based plant.

9. A method according to claim 1, wherein the method further comprises the steps of: continuously, near-continuously or intermittently tapping a predetermined first amount of the withdrawn system oil; and continuously, near-continuously or intermittently replenishing the remaining withdrawn system oil with a predetermined second amount of fresher system oil and providing said replenished system oil to said two-stroke engine.

10. A method according to claim 1, wherein the method further comprises the steps of: continuously, near-continuously or intermittently tapping a predetermined first amount of system oil from the engine; continuously, near-continuously or intermittently replenishing remaining system oil with a predetermined second amount of fresher system oil and providing said replenished system oil to said two-stroke engine.

11. A method according to claim 9, wherein the method further comprises the steps of: determining at least one critical parameter of the tapped system oil; determining at least one desired parameter of a cylinder oil; creating a cylinder oil having a TBN ranging from 40 to 70 by blending the tapped system oil with at least one BN modifying additive in accordance with the at least one critical parameter; and supplying said created cylinder oil to cylinders or part of the cylinders of said engine.

12. A system for reducing fuel consumption in a two-stroke engine comprising:

two-stroke engine that converts fresh system oil having a TBN of less than 10 into partially used system oil by using said fresh system oil as a lubricant during operation of said two-stroke engine;

a friction modifying system, coupled to said two-stroke engine, having at least one friction modifier and a blending unit, wherein said friction modifying system withdraws partially used system oil from the two-stroke engine, wherein said blending unit adds the at least one friction modifier to at least some of the withdrawn partially used system oil to reduce the friction coefficient of the withdrawn partially used system oil, resulting in a system oil with reduced friction and wherein said blending unit supplies said system oil with reduced friction to said two-stroke engine.

13. A system according to claim 12, wherein at least one friction modifier comprises an ash-less friction modifier.

14. A system according to claim 12, wherein said at least one friction modifier is selected from the group consisting of: triglycerides of animal origin, triglycerides of vegetable origin, fatty phosphates, fatty acid amides, fatty epoxides, borated fatty epoxides, fatty amines, polyol esters, borated polyol esters alkoxylated fatty amines, borated alkoxylated fatty amines, metal salts of fatty acids, sulfurized olefins, fatty imidazolines, and mixtures thereof.

15. A system according to claim 12, wherein the system is located offshore, on-site, on-board a vessel, or in a land based plant.

16. A system according to claim 12, wherein a first controller is connected to said two-stroke engine, wherein said first controller continuously, near-continuously or intermittently taps a predetermined first amount of the withdrawn system oil and wherein said first controller continuously, near-continuously or intermittently replenishes the remaining withdrawn system oil with a predetermined second amount of fresher system oil.

17. A system according to claim 12, wherein a first controller is connected to said two-stroke engine, wherein said first controller further continuously, near-continuously or intermittently taps a predetermined first amount of system oil from the two-stroke engine and wherein said first controller further continuously, near-continuously or intermittently replenishes remaining system oil with a predetermined second amount of fresher system oil.

18. A system according to claim 16, wherein the system further comprises: a second controller connected to said first controller, wherein said second controller blends the tapped system oil with at least one BN modifying additive to thereby produce cylinder oil having a target TBN;

a base additive tank connected to said second controller, wherein the base additive tank supplies the at least one BN modifying additive to the second controller;

a cylinder oil supply conduit, connected to said second controller, wherein the cylinder oil supply conduit supplies the cylinder oil having the target TBN to cylinders of said two-stroke engine.

19. A method according to claim 1, wherein said system oil includes consumable system oil, and wherein the method further comprises the steps of: continuously, near-continuously or intermittently tapping a predetermined first amount of consumable system oil from the two-stroke engine; continuously, near-continuously or intermittently replenishing remaining consumable system oil with a predetermined second amount of fresher system oil; and providing replenished system oil to said two-stroke engine.

20. A system according to claim 12, wherein the system further comprises a consumable system oil for use in a two-stroke engine and a first controller connected to said two-stroke engine, wherein said first controller continuously, near-continuously or intermittently taps a predetermined first amount of system oil from the two-stroke engine-and wherein said first controller continuously, near-continuously or intermittently replenishes remaining system oil with a predetermined second amount of fresher system oil.

* * * * *